United States Patent [19]

Tamm et al.

[11] Patent Number: 4,551,183

[45] Date of Patent: Nov. 5, 1985

[54] METHOD FOR IMPROVING THE STRAIGHTNESS OF ROLLED STEEL

[75] Inventors: Franz Tamm, Hennigsdorf; Bernhard Höricke, Falkensee; Kurt Welfle; Michael Seidel, both of Hennigsdorf; Wolfgang Tettke, Falkensee; Karl-Heinz Luckfiel, Hennigsdorf, all of German Democratic Rep.

[73] Assignee: VEB Stahl-und Walzwerk "Wilhelm Florin", Hennigsdorf, German Democratic Rep.

[21] Appl. No.: 635,963

[22] Filed: Jul. 31, 1984

Related U.S. Application Data

[63] Continuation-in-part of Ser. No. 538,865, Oct. 4, 1983, abandoned.

[30] Foreign Application Priority Data

Nov. 24, 1982 [DD] German Democratic Rep. ..... 2451783

[51] Int. Cl.[4] ..... C21D 7/14

[52] U.S. Cl. ..... 148/12 R; 148/12.4; 148/152

[58] Field of Search ..... 148/12 C, 12 D, 12 R, 148/12.4, 152

[56] References Cited

U.S. PATENT DOCUMENTS

| | | | |
|---|---|---|---|
| Re. 30,851 | 1/1982 | Toda et al. | 148/12 D |
| 3,591,427 | 7/1971 | Hansen, Jr. | 148/12 D |

*Primary Examiner*—Wayland Stallard

*Attorney, Agent, or Firm*—Jordan and Hamburg

[57] ABSTRACT

The straightness of rolled steel is improved by controlled cooling with water under pressure which, depending on the composition of the steel, accelerates or retards the $\gamma/\alpha$-conversion and prevents the rolling stock, while on the cooling bed, from being warped or increased in length by the conversion.

8 Claims, No Drawings

METHOD FOR IMPROVING THE STRAIGHTNESS OF ROLLED STEEL

CROSS-REFERENCE TO RELATED APPLICATION

The present application is a continuation-in-part of application Ser. No. 538,865, filed Oct. 4, 1983, now abandoned.

BACKGROUND OF THE INVENTION AND PRIOR ART STATEMENT

The invention relates to a method for improving the straightness of rolled steel, which has a tendency to easily bend due to its cross-sectional measurements.

The invention can be used in metallurgy for the production of rolled steel products.

During the rolling of steel on roll trains with cooling beds, many measurements prove difficult with respect to the straightness of the rolling stock. This problem is especially critical in certain cross-sectional shapes and, as is well known, increases with modern high performance trains, which employ higher speeds, higher final rolling temperatures, and longer cooling beds. Flat stock has a tendency for example because of different moments of resistance, to form waves over the cross-sectional directions, on the one hand, at higher rolling speeds on the supply rolling path to the cooling bed, requiring a limitation of the rolling speed and, on the other hand, the material becomes wavy on the cooling bed. The reason why steel air-cooled on the cooling bed displays inadequate straightness is, for example, that the rolling stock of steel undergoes a structural change from $\gamma$-iron to $\alpha$-iron, during cooling, a process which is combined with a positive volume effect. The increase in volume of the $\gamma/\alpha$ conversion is between the $Ar_3$ and $Ar_1$ or $M_s$ temperatures of the steel and is so strong that the contraction due to cooling is counteracted and the rolling stock experiences an expansion in the mentioned temperature interval. The observed increase in length depends on the chemical composition of the steel and can be approximately 1/5 of the total contraction between 1000° C. and room temperature.

During the actual rolling operation, it has been noted that the roll veins or portions thereof are initially straight on the cooling bed and contracting. Subsequently, they expand and become wavy, since the friction prevents gliding. In the case of continued decrease in temperature, the rolled steel again contracts, however, the waviness already present does not completely recede due to increasing firmness during continued cooling.

Experience shows that the straightness of rolled steel is improved by lowering the final rolling temperature. Technical measures, taken already during the production, which bring about a noticeable improvement in the straightness, are now known. The straightness required for the use or continued processing of the steel is often accomplished by additional measures, for example, subsequent straightening.

SUMMARY OF THE INVENTION

It is an object of the invention to produce hot-rolled steel of various cross-sectional shapes with a straightness which meets most demands on continued processing and use in a rolled state. Furthermore, the swelling of the rolled steel on the cooling bed is to be made more stable, allowing higher rolling speeds. The adjustment passage, particularly the leveling, the transport, and the cold cutting, are facilitated, and the proportion of the product that satisfies the higher demands on straightness, is increased.

It is an object of the invention to develop a method with which the susceptibility of the warm rolling stock to warping on the cooling bed is eliminated.

This object is accomplished in the present invention by controlled cooling with water under pressure which accelerates or retards the $\gamma/\alpha$ conversion compared to the usual conversion on the cooling bed. The effect depends on the chemical composition of the steel, and prevents a conversion-related length increase of the rolling stock on the cooling bed.

It is an additional feature of the present invention that in unalloyed carbon steels, adjustment temperatures subsequent to the controlled cooling by water under pressure correspond to the pearlite nose in the ZTU display, and that the $\gamma/\alpha$ conversion of a cross-sectional portion close to the surface occurs at the maximum conversion speed of the pearlite step, and thus largely or completely during the transport of the extended rolling stock in an axial direction on the roll train to the cooling bed.

As commonly understood, and with regard to the meaning of the expression "ZTU-Display", this expression means time-temperature-conversion-display, which corresponds to the English "TTT-diagram", i.e., time-temperature-transformation diagram.

It is a third characteristic of the invention that in unalloyed steel or low alloy steel with a low carbon content, martensite is formed during the measured pressure water cooling in a cross-sectional portion close to the surface of the rolling stock with part of the length increase due to the conversion being anticipated by the cooling during the continuous movement of the roll vein in an axial direction.

The solution provided by the invention further has the characteristic that in alloyed steels subsequent to the measured pressure water cooling, the $\gamma/\alpha$-conversion occurs on the lower pearlite level or in the upper intermediate level with lower conversion speeds than during normal air cooling.

DETAILED DESCRIPTION OF PREFERRED EMBODIMENTS OF THE INVENTION

The invention is more fully explained by means of an example.

In order to improve the straightness of the flat stock of unalloyed steel with 0.45% C., pressure water chilling with the temperature adjustment at approximately 640°–680° C., following completed warm-forming prior to the swelling on the cooling bed, has proven particularly effective. A length increase during the cooling on the cooling bed was not detected. Obviously, the $\gamma/\alpha$-conversion, according to the treatment in the invention, mainly occurs on the transport route to the cooling bed. The straightness of the rolling stock was considerably improved.

As an additional example, the improved straightness of flat stock of abated and unabated weldable structural steel with low carbon contents is mentioned. Pressure water cooling at surface temperatures of 200° C. with temperature equalization at approximately 650° C. led to excellent results. The $M_s$ points of these steels were relatively high at approximately 420° C. so that martensite was formed in a considerable cross-sectional area close to the edge, which was highly tempered to a heat treatable structure. The result in the invention was achieved by the volume effect, due to conversion, occurring with martensite formation during cooling. The martensite edge areas shrunk during the subsequent air cooling on the cooling bed preventing a longitudinal expansion.

As a further example, from the production program of a Konti double-refined steel path we have detailed 5 brands of steel, covered with 21 charges, and compiled the essential technological data for the use of the method in the invention in Table 1. The desired straightness is listed as the deviation of the median line of the rolled steel from the straight line in millimeters per meter of length of the rolled steel.

Further, it should be noted that the execution of the forging at high temperatures with high rolling speed is a possible advantage of the method, with an improvement of the roll's service life of about 50% as an additional economical effect, and with the rising of the rolled steel on the cooling bed being improved, enabling the high rolling speeds.

TABLE 1

Embodiments for improving the straightness on a Konti refined steel path

| No. | Steel brand | C % | Si % | Mn % | P % | S % | Measurement mm | rolling end temp. °C. | cooling time S | equalizing temp °C. | rolling speed m/s | straightness mm/m |
|---|---|---|---|---|---|---|---|---|---|---|---|---|
| 1 | St 38u-2 | 0.12 | 0.06 | 0.51 | 0.035 | 0.038 | 5 × 25 | 980 | 0.33 | 750 | 15 | |
| 2 | | 0.19 | 0.03 | 0.59 | 0.039 | 0.040 | 5 × 40 | 980 | 0.38 | 740 | 13 | |
| 3 | | 0.15 | 0.03 | 0.52 | 0.032 | 0.036 | 5 × 60 | 1000 | 0.47 | 760 | 10.5 | |
| 4 | | 0.19 | 0.05 | 0.49 | 0.032 | 0.038 | 6 × 40 | 1000 | 0.38 | 760 | 13 | |
| 5 | | 0.14 | 0.06 | 0.48 | 0.036 | 0.041 | 6 × 60 | 1000 | 0.57 | 720 | 8.7 | |
| 6 | St 38b-2 | 0.15 | 0.25 | 0.60 | 0.041 | 0.035 | 5 × 40 | 1020 | 0.38 | 730 | 13 | |
| 7 | | 0.16 | 0.28 | 0.59 | 0.032 | 0.036 | 5 × 60 | 1010 | 0.47 | 765 | 10.5 | |
| 8 | | 0.13 | 0.30 | 0.55 | 0.037 | 0.041 | 6 × 40 | 1020 | 0.38 | 765 | 13 | |
| 9 | 50SiMn7 | 0.49 | 1.70 | 0.65 | 0.031 | 0.035 | 5 × 50 | 980 | 0.47 | 720 | 10.5 | |
| 10 | | 0.52 | 1.65 | 0.80 | 0.028 | 0.032 | 5 × 60 | 980 | 0.47 | 765 | 10.5 | |
| 11 | | 0.53 | 1.72 | 0.81 | 0.025 | 0.036 | 6 × 40 | 1000 | 0.38 | 760 | 13 | 4 to 5 |
| 12 | | 0.49 | 1.90 | 0.75 | 0.031 | 0.030 | 6 × 60 | 1000 | 0.57 | 720 | 8.7 | |
| 13 | 55SiMn7 | 0.59 | 1.75 | 0.76 | 0.029 | 0.031 | 5 × 40 | 1040 | 0.38 | 760 | 13 | |
| 14 | | 0.56 | 1.90 | 0.62 | 0.027 | 0.026 | 5 × 50 | 1040 | 0.47 | 740 | 10.5 | |
| 15 | | 0.59 | 1.91 | 0.71 | 0.029 | 0.029 | 5 × 60 | 1060 | 0.47 | 780 | 10.5 | |
| 16 | | 0.57 | 1.86 | 0.87 | 0.021 | 0.031 | 6 × 60 | 1050 | 0.57 | 740 | 8.7 | |
| 17 | 60SiMn7 | 0.61 | 1.66 | 0.81 | 0.030 | 0.026 | 5 × 40 | 1040 | 0.38 | 760 | 13 | |
| 18 | | 0.63 | 1.66 | 0.80 | 0.029 | 0.050 | 6 × 40 | 1060 | 0.38 | 790 | 13 | |
| 19 | | 0.65 | 1.90 | 0.75 | 0.025 | 0.030 | 6 × 25 | 1040 | 0.36 | 770 | 14 | |
| 20 | | 0.62 | 1.75 | 0.87 | 0.031 | 0.032 | 5 × 50 | 1070 | 0.47 | 760 | 10.5 | |
| 21 | | 0.62 | 1.78 | 0.76 | 0.026 | 0.029 | 6 × 50 | 1080 | 0.47 | 790 | 10.5 | |

[1]Deviation of the median line from the straight line in millimeters per meter length In summary, the invention relates to a method for improving the straightness of rolled steel which can be used in metallurgy. It is the object of the invention to produce rolled steel with a straightness which meets the demands of the machining industry. Furthermore, the production process in the rolling mills is made more stable. It is another object of the invention to develop a method eliminating the susceptibility of the warm rolling stock to warping on the cooling bed.

This is accomplished in that the $\gamma/\alpha$-conversion is accelerated or retarded, compared to the normal process on the cooling bed, depending on the chemical composition of the steel, preventing a conversion-related length increase in the processed rolling stock on the cooling bed.

It thus will be seen that there is provided a method for improving the straightness of rolled steel which attains the various objects of the invention, and which is well adapted for the conditions of practical use. As numerous alternatives within the scope of the present invention will occur to those skilled in the art, besides those equivalents, alternatives and variations mentioned supra, it will be understood that the invention is limited only by the scope of the appended claims, and structural and functional equivalents thereof.

We claim:

1. Method for improving the straightness of rolled steel during cooling in one or more steps, prior or subsequent to the finished degree of cooling or prior or subsequent to the last forming process, characterized in that the $\gamma/\alpha$-conversion is accelerated or retarded by measured pressure water cooling as compared to the normal process on the cooling bed, depending on the chemical composition of the steel and that in this manner a conversion-related length increase on the cooling bed is prevented in the processed rolling stock.

2. Method according to claim 1, characterized in that unalloyed carbon steel equalization temperatures corresponding to the pearlite nose in the ZTU display occur following the measured pressure water cooling and the $\gamma/\alpha$-conversion of a cross-sectional portion close to the surface occurs at the maximum conversion speed of the pearlite step and to a large degree or completely during the transport of the expanded, rolling stock in an axial direction on the roll train to the cooling bed.

3. Method according to claim 1, characterized in that in unalloyed and low alloy steels with low carbon contents, martersite is formed in a cross-sectional portion, close to the surface, of the rolling stock during the measured pressure water cooling with part of the length increase due to conversion being anticipated during the cooling at continuous movement of the roll vein in the axial direction.

4. Method according to claim 1, characterized in that in alloy steels, following the measured pressure water cooling, the conversion occurs in the lower pearlite step or in the upper intermediate step with lower conversion speed than

5. A method for increasing the straightness of hot rolled steel, comprising hot rolling the steel on a rolling train having a cooling bed and then cooling the steel on the cooling bed by applying thereto water under pressure thereby to change the rate of $\gamma/\alpha$-conversion and prevent the length of the stock from increasing on the cooling bed.

6. A method according to claim 5 in which control is assisted by means of a ZTU display, the steel is unalloyed carbon steel and the water cooling is controlled to adjust the temperature of the steel to that corresponding to the pearlite nose in the ZTU display and the $\gamma/\alpha$-conversion occurs close to the surface at the maximum conversion rate of the pearlite step and largely or completely during the transport of the expanded rolling stock to the cooling bed.

7. A method according to claim 5 in which during the hot rolling a roll vein is formed on the surface of the steel, the steel is low-carbon unalloyed or low alloy steel and martensite forms close to the surface of the steel during the water cooling and part of the length increase due to the $\gamma/\alpha$-conversion occurs during the axial movement of the roll vein.

8. A method according to claim 5 in which the water cooling of alloy steel is followed by decelerated $\gamma/\alpha$-conversion in the lower pearlite step or upper intermediate step.

* * * * *